US006595809B2

(12) United States Patent
Matsumoto et al.

(10) Patent No.: US 6,595,809 B2
(45) Date of Patent: Jul. 22, 2003

(54) CONNECTION DEVICE

(75) Inventors: Atsushi Matsumoto, Osaka (JP); Masaaki Fujii, Osaka (JP); Masatake Yamano, Osaka (JP)

(73) Assignee: Idec Izumi Corporation, Osaka (JP)

( * ) Notice: Subject to any disclaimer, the term of this patent is extended or adjusted under 35 U.S.C. 154(b) by 0 days.

(21) Appl. No.: 10/030,135

(22) PCT Filed: May 23, 2001

(86) PCT No.: PCT/JP01/04339

§ 371 (c)(1),
(2), (4) Date: Jan. 25, 2002

(87) PCT Pub. No.: WO01/91240

PCT Pub. Date: Nov. 29, 2001

(65) Prior Publication Data

US 2003/0008569 A1 Jan. 9, 2003

(30) Foreign Application Priority Data

May 26, 2000 (JP) ..... 2000-156461

(51) Int. Cl.[7] ..... H01R 4/48
(52) U.S. Cl. ..... 439/835; 439/372
(58) Field of Search ..... 439/834, 835, 439/836, 837, 838, 839, 372

(56) References Cited

U.S. PATENT DOCUMENTS 5,679,021 A 10/1997 Kramer ..... 439/835
6,004,168 A * 12/1999 Fuchs et al. ..... 439/835
6,010,376 A 1/2000 Kollmann ..... 439/834
6,270,384 B2 * 8/2001 Jaag ..... 439/835

FOREIGN PATENT DOCUMENTS

| | | |
|---|---|---|
| JP | 9-320657 | 12/1997 |
| JP | 11-86939 | 3/1999 |
| WO | WO 00/21160 | 4/2000 |

* cited by examiner

*Primary Examiner*—P. Austin Bradley
*Assistant Examiner*—Truc Nguyen
(74) *Attorney, Agent, or Firm*—Armstrong, Westerman & Hattori, LLP

(57) ABSTRACT

A connector comprises locking springs 3 in which fixed pieces 31 are combined with movable pieces 32 via resilient transformed parts 33 and pushing parts 34 and in which the tips of the fixed pieces 31 are inserted into connection holes 32*a* formed in the movable pieces 32; a case 1 for accommodating the locking springs 3; terminal fittings 2 locating on the outer surfaces of the fixed pieces of the locking springs 3; wire slots 11*b* formed opposite to the movable pieces 32 of the locking springs 3; and levers 4 for pressing the pushing parts 34 of the locking springs 3. When the lever 4 is in a non-operative position, tool entrances 11*c* are provided at an opening 11*a* which accepts the lever 4. Each tool entrance 11*c* leads to a contact area where the lever 4 meets the pushing part 34 of the locking spring 3.

4 Claims, 14 Drawing Sheets

CONNECTION DEVICE

TECHNICAL FIELD

The present invention relates to a connector which is used at an electric wire connection for electric equipment (e.g. a control unit, a switch), a terminal block, etc.

BACKGROUND ART

A connector with a locking spring has been applied at an electric wire connection for electric equipment, etc. FIG. 22 shows an example of this connector.

Regarding this example, a locking spring 303 is a lock-like component made of a strip of plate spring. In this component, a fixed piece 331 is combined with a movable piece 332, via a resilient transformed part 333 and a pushing part 334. The tip of the fixed piece 331 is inserted into and latched with a connection hole 332*a* formed in the movable piece 332. The fixed piece 331 of the locking spring 303 is secured on a terminal fitting 302 which is accommodated in a case 301.

The case 301 has a wire slot 301*a* and a tool entrance 301*b*. When the tip of a screwdriver 5 is inserted in the tool entrance 301*b* to press the pushing part 334 of the locking spring 303, the locking spring 303 is made to deflect such that the connection hole 332*a* in the movable piece 332 faces the wire slot 301*a*. In this state, an electric wire 200 is inserted in the wire slot 301*a*, allowing a conductor 201 at the leading end to enter the connection hole 332*a* The screwdriver 5 is pulled out at this stage. Then, owing to the resilience of the locking spring 303, the conductor 201 of the electric wire 200 is pinched between the terminal fitting 302 and an edge of the connection hole 332*a*. Eventually, the conductor 201 is connected to the terminal fitting 302.

It should be noted that the conventional connector illustrated in FIG. 20 requires a screwdriver or other tool in order to carry out the connecting operation.

Taking such circumstances into consideration, the present invention intends to provide a connector which can simplify wire connecting operations by not using a screwdriver or other tool, and which still enables the use of a screwdriver or other tool in wire connecting operations, when necessary.

DISCLOSURE OF THE INVENTION

A connector of the present invention is characterized in comprising: a locking spring which is a lock-like component made of a strip of plate spring, in which a fixed piece is combined with a movable piece via a resilient transformed part and a pushing part, and in which a tip of the fixed piece is inserted into a connection hole formed in the movable piece; a case for accommodating the locking spring; a terminal fitting which locates on an outer surface of the fixed piece of the locking spring; a wire slot formed opposite to the movable piece of the locking spring; and a lever which locates in an opening of the case and which serves to press the pushing part of the locking spring. This connector is also characterized in that the connection hole faces the wire slot, when the pushing part of the locking spring is pressed by operating the lever. The connector is further characterized in that, when the lever is in a non-operative position, a tool entrance is provided at the opening in such a manner that the tool entrance leads to a contact area where the lever meets the pushing part of the locking spring.

In the connector of the present invention, the lever may be provided with a locking mechanism for preventing accidental operations.

This locking mechanism may comprise a slidable stopper provided on the lever and a latch part provided on the case for latching the stopper, so that the lever can be fixed at a predetermined position by latching the stopper on the latch part.

In another locking mechanism, the lever may be designed upwardly slidable. When this lever is made to slide to a predetermined position, the locking mechanism is arranged to release the locked state and to make the lever rotatable.

In an alternative locking mechanism, the lever may be designed upwardly slidable. When this lever is made to slide to a predetermined position, the locking mechanism is arranged to make the lever swingable. Besides, the resulting swinging movement is arranged to cause the release of the locked state and to make the lever rotatable.

According to the connector of the present invention, wire connecting operations can be carried out simply by operating the lever with a finger, etc., instead of using a screwdriver or other tool. Besides, while the lever is in the non-operative position, the connector provides a tool entrance at the case opening for accepting the lever, such that the tool entrance leads to a contact area where the lever meets the pushing part of the locking spring. This tool entrance enables the use of a screwdriver or other tool in wire connecting operations.

Hence, this connector is adaptable to wire connecting operations at various places, including a narrow space where the lever cannot be operated with a finger, etc. For example, if the space is limited, an electric wire can be connected by means of a screwdriver.

Further, the tool entrance locates at the opening for accepting the lever, and the lever serves as a fulcrum for operating the screwdriver. This structure can dispense with a separate tool entrance, and helps to achieve the above effects in a space-saving environment.

BRIEF DESCRIPTION OF DRAWINGS

FIG. 14(*b*) is a side view thereof.

BEST MODE FOR CARRYING OUT THE INVENTION

Embodiments of the present invention are hereinafter described with reference to the drawings.

Figure 1:
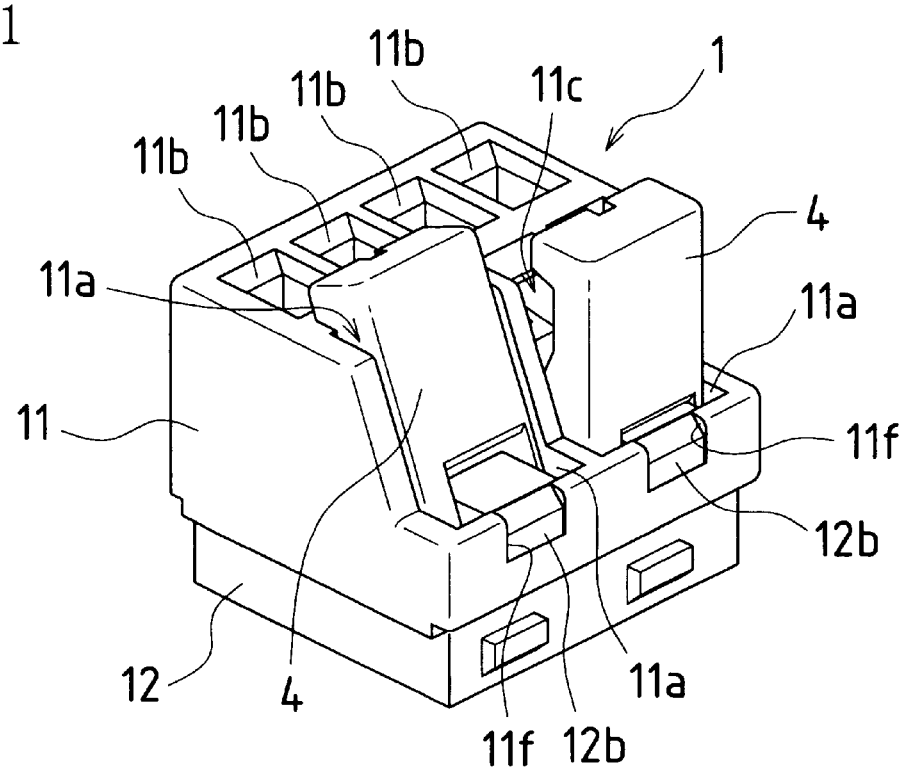
FIG. 1 to FIG. 4 are perspective views of an embodiment of the present invention.
Figure 2:
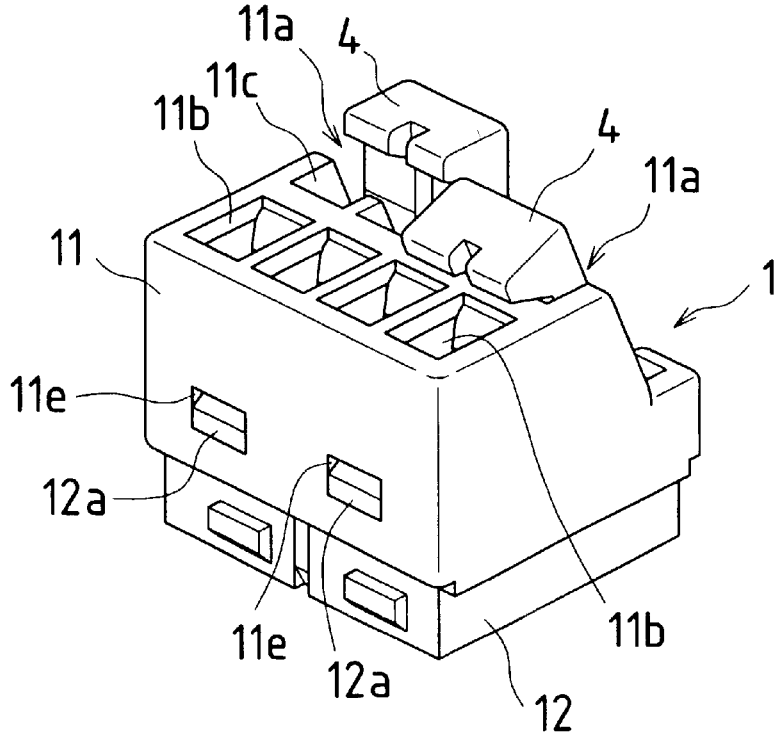
Figure 3:
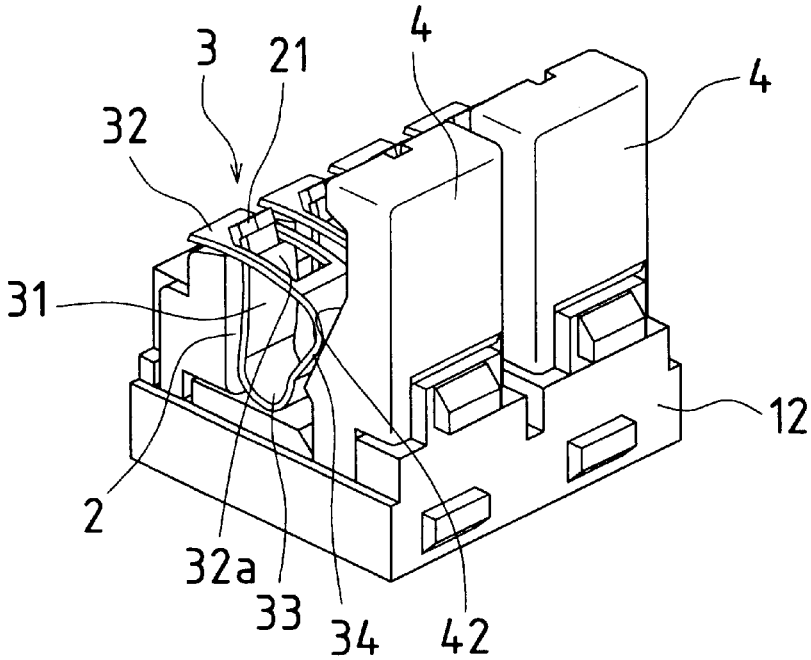
Figure 4:
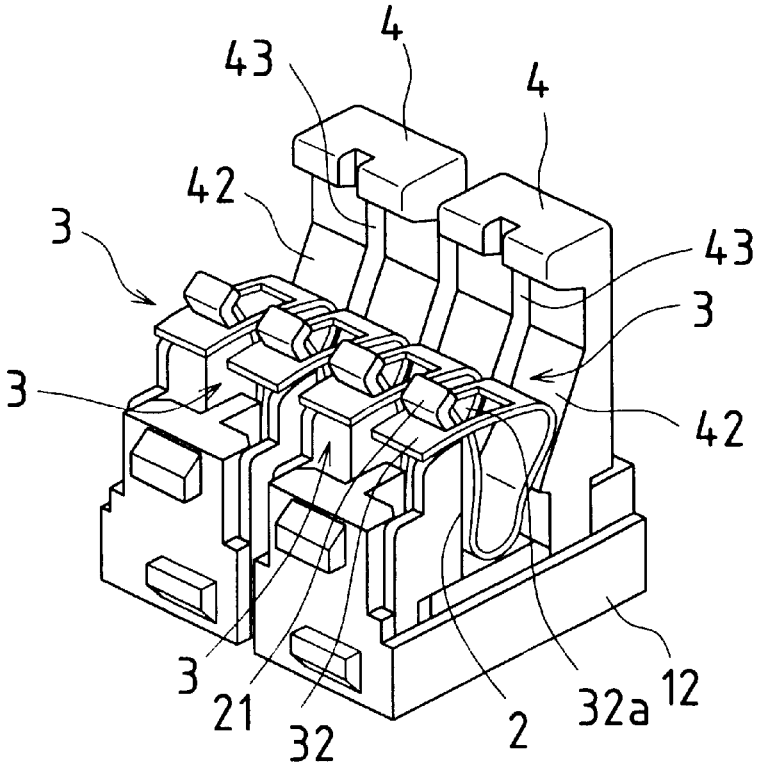

FIG. 1 to FIG. 4 are perspective views of an embodiment of the present invention. Among them, FIG. 3 and FIG. 4 provide the views where a top case 11 is removed.

Figure 5:
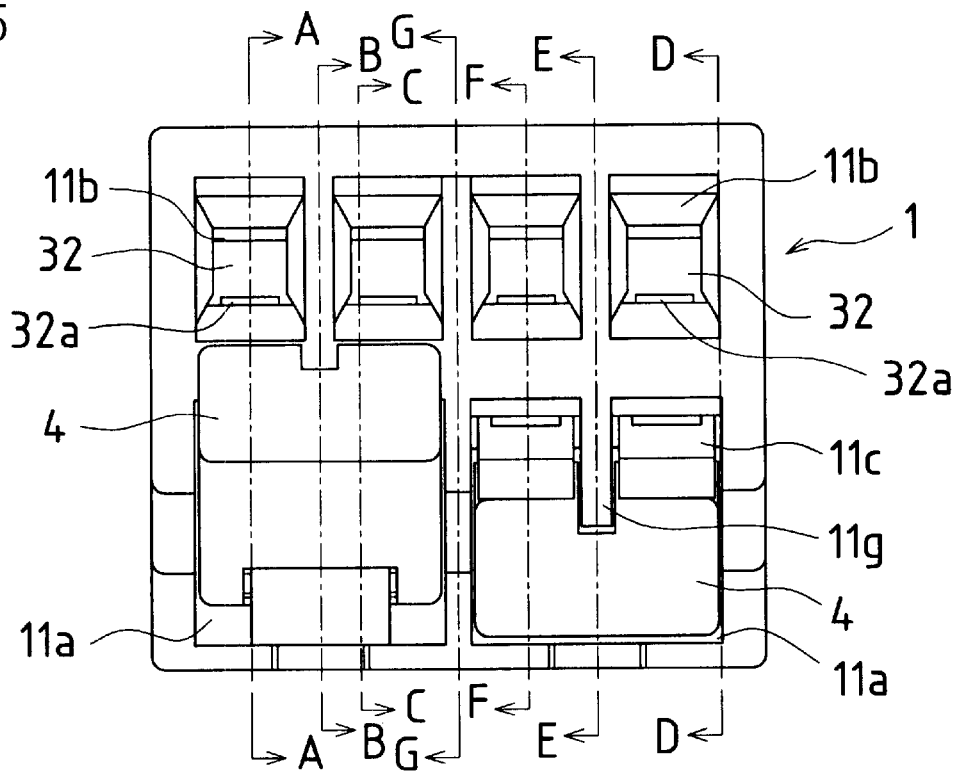
FIG. 5 is a plan view of the embodiment of the present invention.
Figure 13:
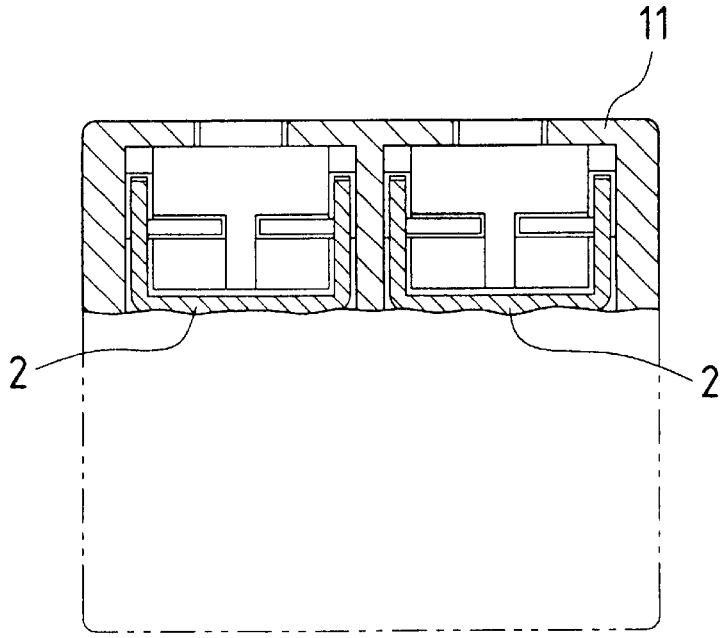
FIG. 13 is a sectional view taken along the line H—H in FIG. 6.

FIG. 5 is a plan view of the embodiment of the present invention. FIG. 6 to FIG. 12 are sectional views taken along the lines A—A to G—G in FIG. 5, respectively. FIG. 13 is a sectional view taken along the line H—H in FIG. 6.

A connector of this embodiment is mainly composed of a case 1, two terminal fittings 2, 2, four locking springs 3 . . . 3, and two levers 4, 4.

The case 1 is made of a resin molded article (e.g. polyamide). It is composed of a top case 11 having two openings 11*a*, 11*a* for accepting the levers, and a bottom case 12 integrated with the top case 11 in the manner described below.

The top case 11 is formed with latch holes 11*e* and latch recesses 11*f*. The bottom case 12 is provided with latch pawls 12*a*, 12*b* which locate in correspondence with the latch holes lie and latch recesses 11*f* in the top case 11. By engaging the latch holes 11*e* and latch recesses 11*f* with the latch pawls 12*a*, 12*b*, the top case 11 and the bottom case 12 are integrated with each other.

In the top case 11, wire slots 11*b* . . . 11*b* situate opposite to respective movable pieces 32 of the four locking springs 3 . . . 3 to be mentioned below. In addition, a guiding plate 11*g* is furnished in the middle of each opening 11*a* in the top case 11.

The bottom case 12 contains a bearing recess 121 which holds a rotatable support 41 of each lever 4 to be described later. The bearing recess 121 is composed of a fitting hole 121*a* and an arc-shaped guiding surface 121*b*.

Figure 9:
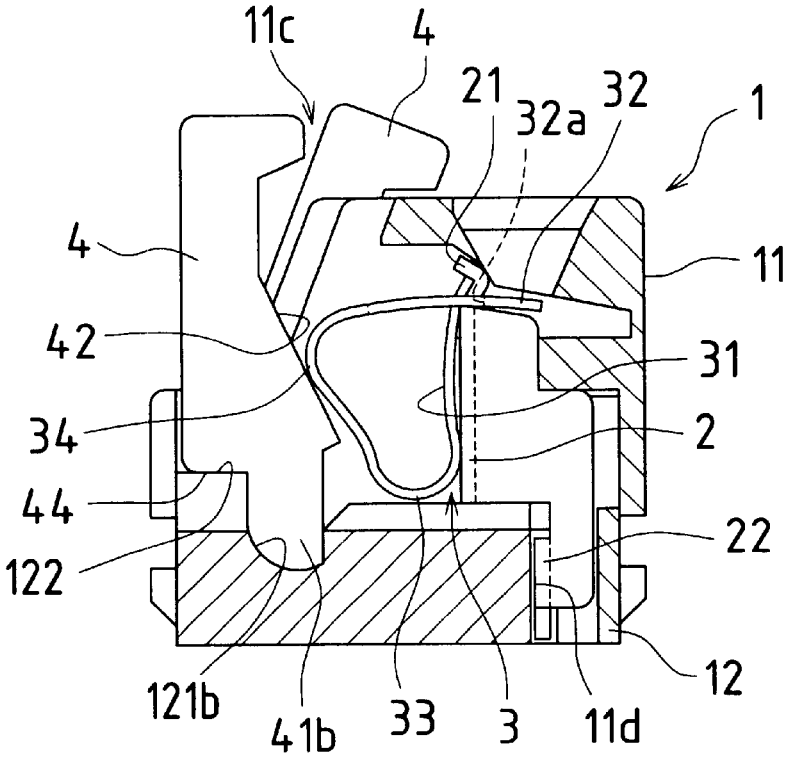
FIG. 9 is a sectional view taken along the line D—D in FIG. 5.
Figure 10:
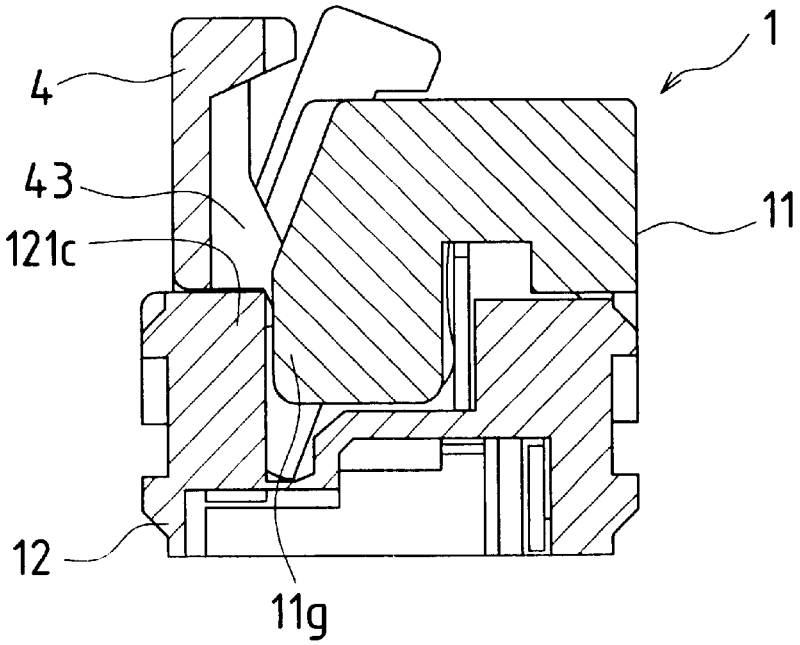
FIG. 10 is a sectional view taken along the line E—E in FIG. 5.
Figure 11:
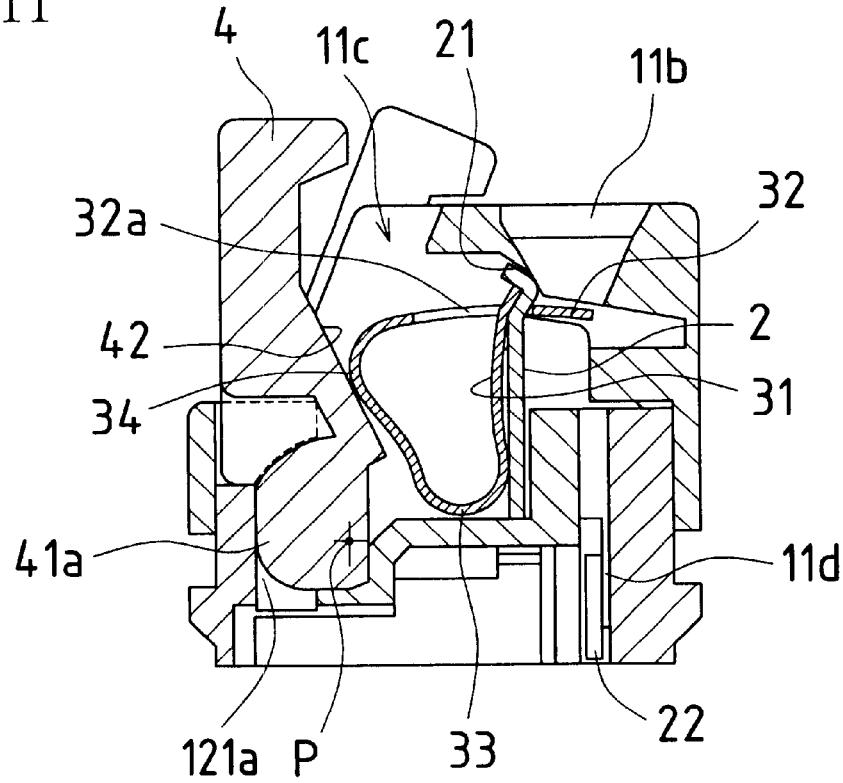
FIG. 11 is a sectional view taken along the line F—F in FIG. 5.
Figure 12:
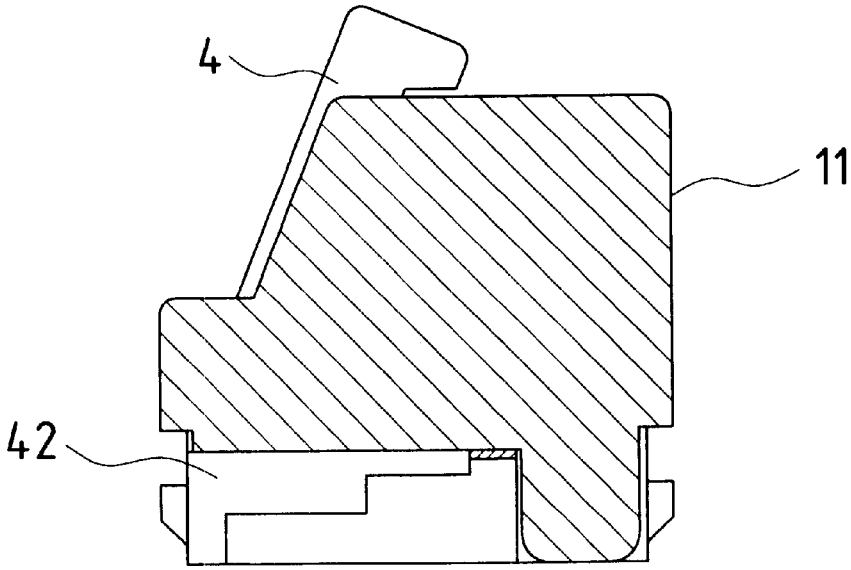
FIG. 12 is a sectional view taken along the line G—G in FIG. 5.

Each of the terminal fittings 2 is an approximately channel-shaped component obtained by bending a metal plate (e.g. brass). The front end of the terminal fitting 2 is furnished with two latch pawls 21, 21, and the rear end constitutes a terminal plate 22. As illustrated in FIG. 9 and FIG. 11, each terminal fitting 2 is fixed on the bottom case 12 by inserting the terminal plate 22 into a through-hole lid formed in the bottom case 12.

Each of the locking springs 3 is a lock-like component made of a strip of plate spring (e.g. stainless steel plate spring). A fixed piece 31 is combined with a movable piece 32, via a resilient transformed part 33 and a pushing part 34. A connection hole 32*a* is formed in the movable piece 32. The tip of the fixed piece 31 is inserted into and latched with the connection hole 32*a*.

Each terminal fitting 2 is equipped with two locking springs 3. To fix these locking spring 3 on the terminal fitting 2, the latch pawls 21 of the terminal fitting 2 are interposed between the movable pieces 32 and edges of the connection holes 32*a*, with the outer surfaces (the surfaces not facing the pushing parts 34) of the fixed pieces 31 abutting on the terminal fitting 2.

Figure 14:
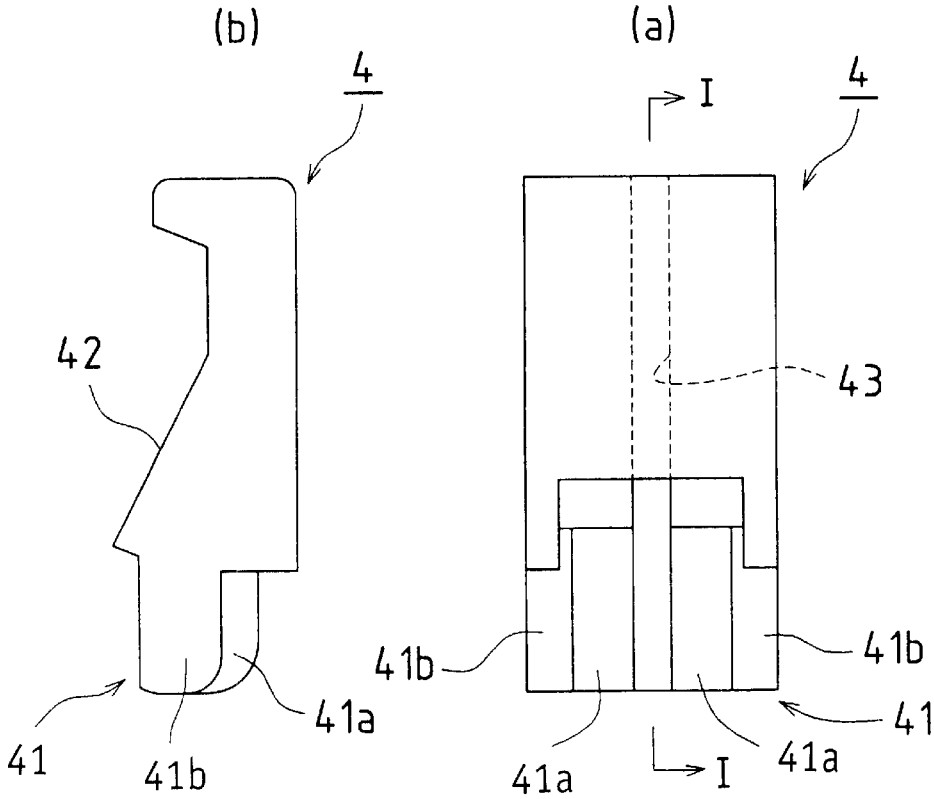
FIG. 14(*a*) is a front view of a lever used in the embodiment of the present invention.
Figure 15:
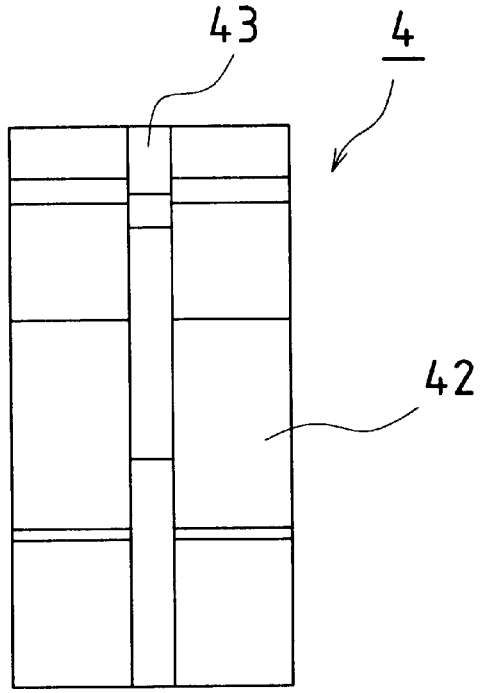
FIG. 15 is a rear view of the lever.
Figure 16:
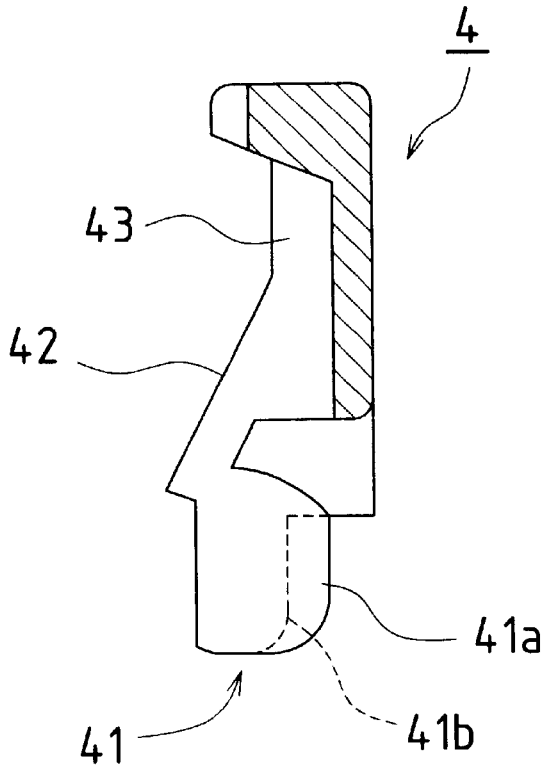
FIG. 16 is a sectional view taken along the line I—I in FIG. 14.

Each lever 4 is made of a resin molded article (e.g. polyamide). As illustrated in FIG. 14 to FIG. 16, one end (bottom end) of the lever 4 constitutes a rotatable support 41. The inner side of the lever 4 is defined by an inclined surface 42 for pressing the pushing part 34 of the locking spring 3. In addition, a slit groove 43 extends longitudinally in the middle of the inner side of the lever 4.

The rotatable support 41 of the lever 4 has a stepped structure composed of a fitting projection 41*a* and guiding portions 41*b* formed on both sides thereof. To mount the rotatable support 41 in the bottom case 12, the fitting projection 41*a* is fitted into the fitting hole 121*a* in the bearing recess 121 of the bottom case 12. In this mounting state, the lever 4 held in the bottom case 12 is rotatable around the point P (FIG. 11).

According to this embodiment, when the lever 4 is in a vertical posture relative to the bottom case 12, as shown in FIG. 9, a restriction surface 44 of the lever 4 contacts a restriction surface 122 of the bottom case 12, thereby limiting outward rotation of the lever 4. If the lever 4 in the vertical posture is depressed against the resilience of the locking springs 3, the locking springs 3 are made to deflect such that the connection holes 32*a* in the movable pieces 32 are positioned face to face with the wire slots 11*b*.

Additionally, while the lever 4 is in the vertical posture (non-operative position), the inclined surface 42 of the lever 4 contacts the pushing parts 34 of the locking springs 3. At the same time, tool entrances 11*c*, 11*c* are defined between the lever 4 and the top case 11 (the opening 11*a* for accepting the lever), with each entrance locating opposite to the respective locking spring 3. Through either of these tool entrances 11*c*, 11*c*, the tip of the screwdriver 5 can enter as far as the contact area where the inclined surface 42 of the lever 4 meets the pushing part 34 of the locking spring 3 (see FIG. 17).

The present embodiment is used in the following manner. For this description, reference can be made to FIG. 1 to FIG. 13 and FIG. 17.

Figure 6:
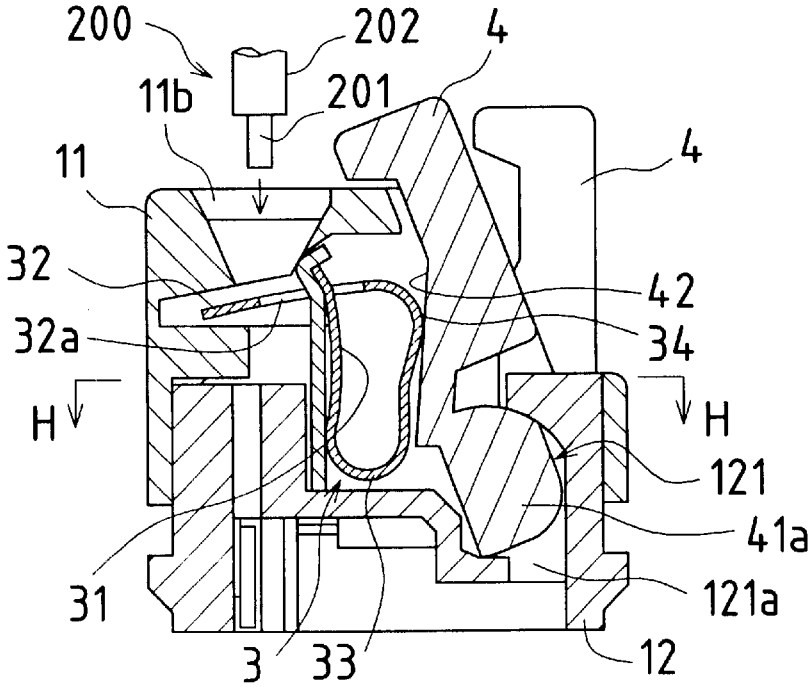
FIG. 6 is a sectional view taken along the line A—A in FIG. 5.
Figure 7:
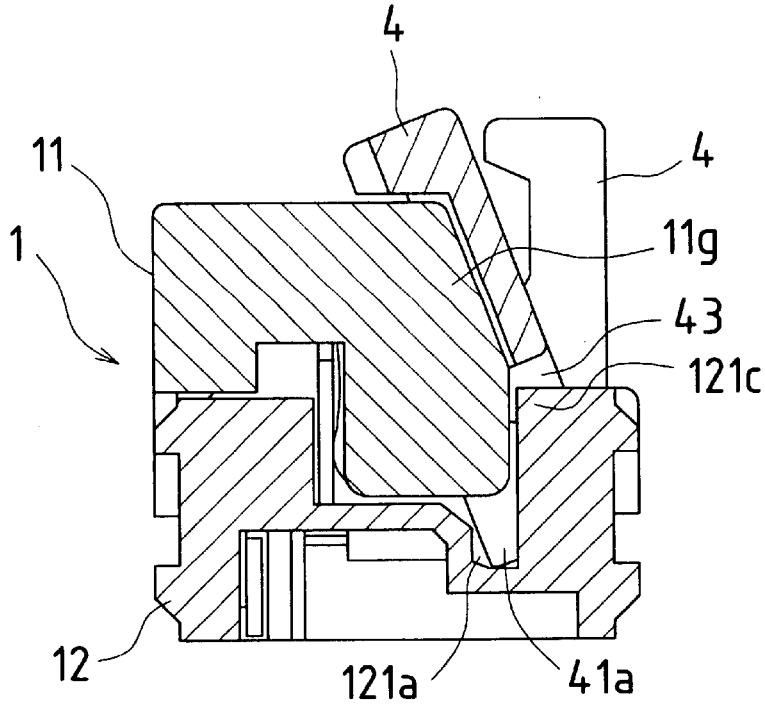
FIG. 7 is a sectional view taken along the line B—B in FIG. 5.

For the purpose of preparation, electric wires 200 for connection have their insulative coating layers 202 stripped, and thereby have their conductors 201 exposed (see FIG. 6).

Figure 8:
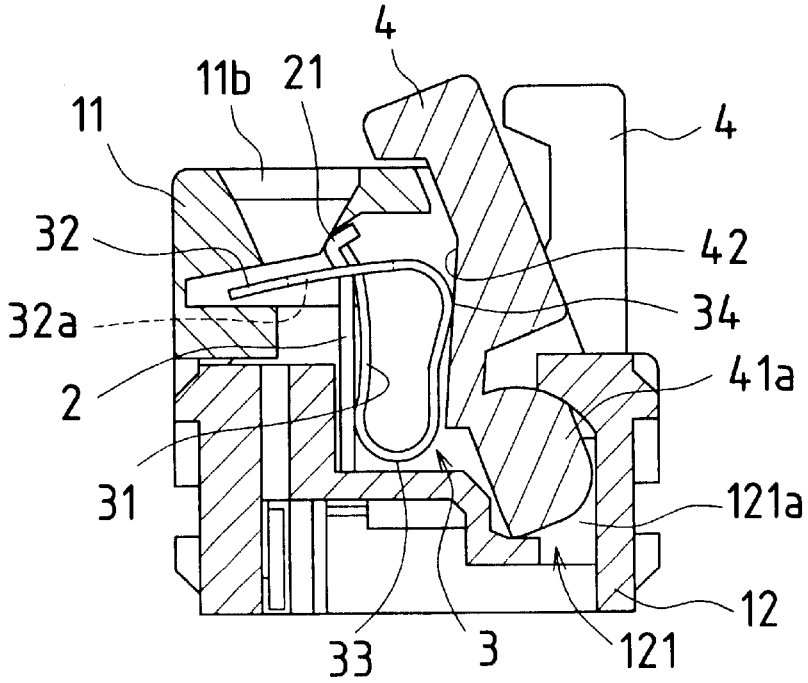
FIG. 8 is a sectional view taken along the line C—C in FIG. 5.

Secondly, as depicted in FIG. 6 and FIG. 8, while the lever 4 is depressed with a finger or the like against the resilience of the locking springs 3, the electric wires 200 are inserted into the wire slots 11*b*. After the conductors 201 pass through the connection holes 32*a* in the locking springs 3, depression of the lever 4 is released. Then, due to the resilience of the locking springs 3, the conductors 201 of the electric wires 200 are pinched between the terminal fitting 2 and the edges of the connection holes 32*a*, so that the conductors 201 are connected to the terminal fitting 2. At the same time, the resilience of the locking springs 3 returns the lever 4 to the vertical posture.

In this connected state, the electric wires 200 can be disconnected from the terminal fitting 2 by pulling the electric wires 200 out of the wire slots 11*b*, while the lever 4 is kept depressed against the resilience of the locking springs 3.

In the case of this embodiment, the tool entrances 11*c* are defined between the top case 11 and the lever 4 in the vertical posture (non-operative position). Each of these tool entrances 11*c* enables the use of a screwdriver 5 in wire connecting operations.

Figure 17:
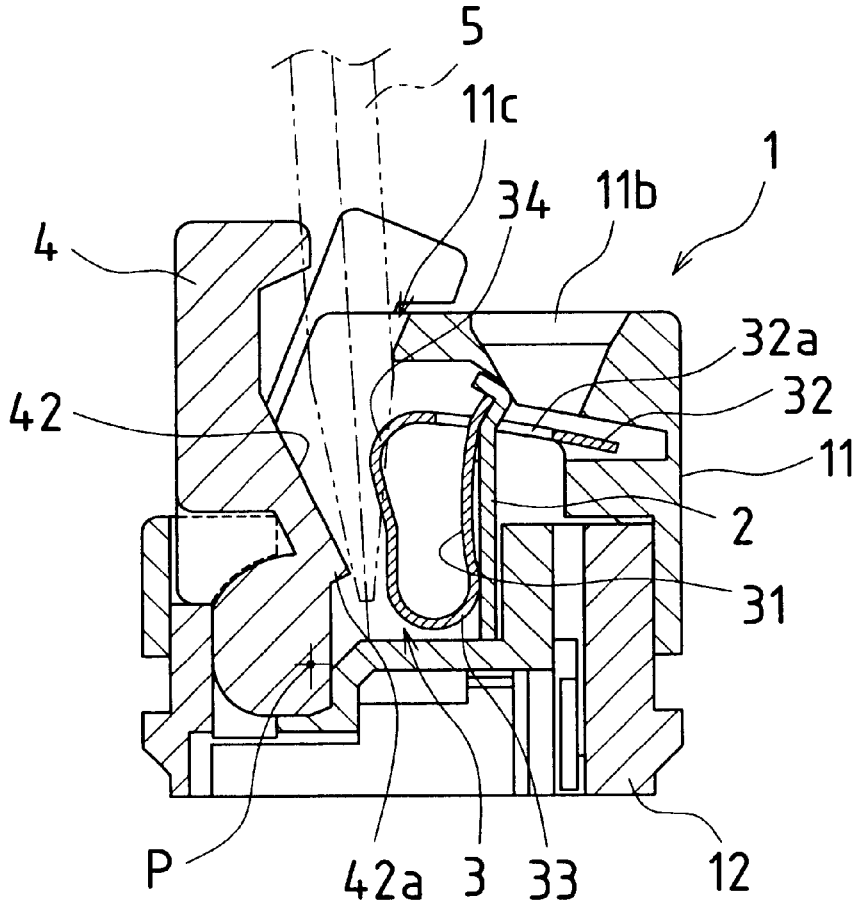
FIG. 17 illustrates an operation of the embodiment of the present invention.

To be specific, as shown in FIG. 17, the screwdriver 5 is inserted through each tool entrance 11*c*, forcing the tip of the screwdriver in between the inclined surface 42 of the lever 4 and the pushing part 34 of the locking spring 3. At this moment, utilizing a corner 42*a* of the inclined surface 42 of the lever 4 as the fulcrum, the screwdriver 5 presses the pushing part 34 of the locking spring 3, so that the locking spring 3 is made to deflect in the same manner as operated by the lever 4. In this state where the connection hole 32*a* in the locking spring 3 locates face to face with the wire slot 11*b*, the conductor 201 of the electric wire 200 is inserted into the connection hole 32*a* in the locking spring 3. The screwdriver 5 is pulled out of the tool entrance 11*c* at this stage. Then, owing to the resilience of the locking spring 3, the conductor 201 of the electric wire 200 is pinched between the terminal fitting 2 and the edge of the connection hole 32*a*. Eventually, the conductor 201 is connected to the terminal fitting 2.

Figure 18:
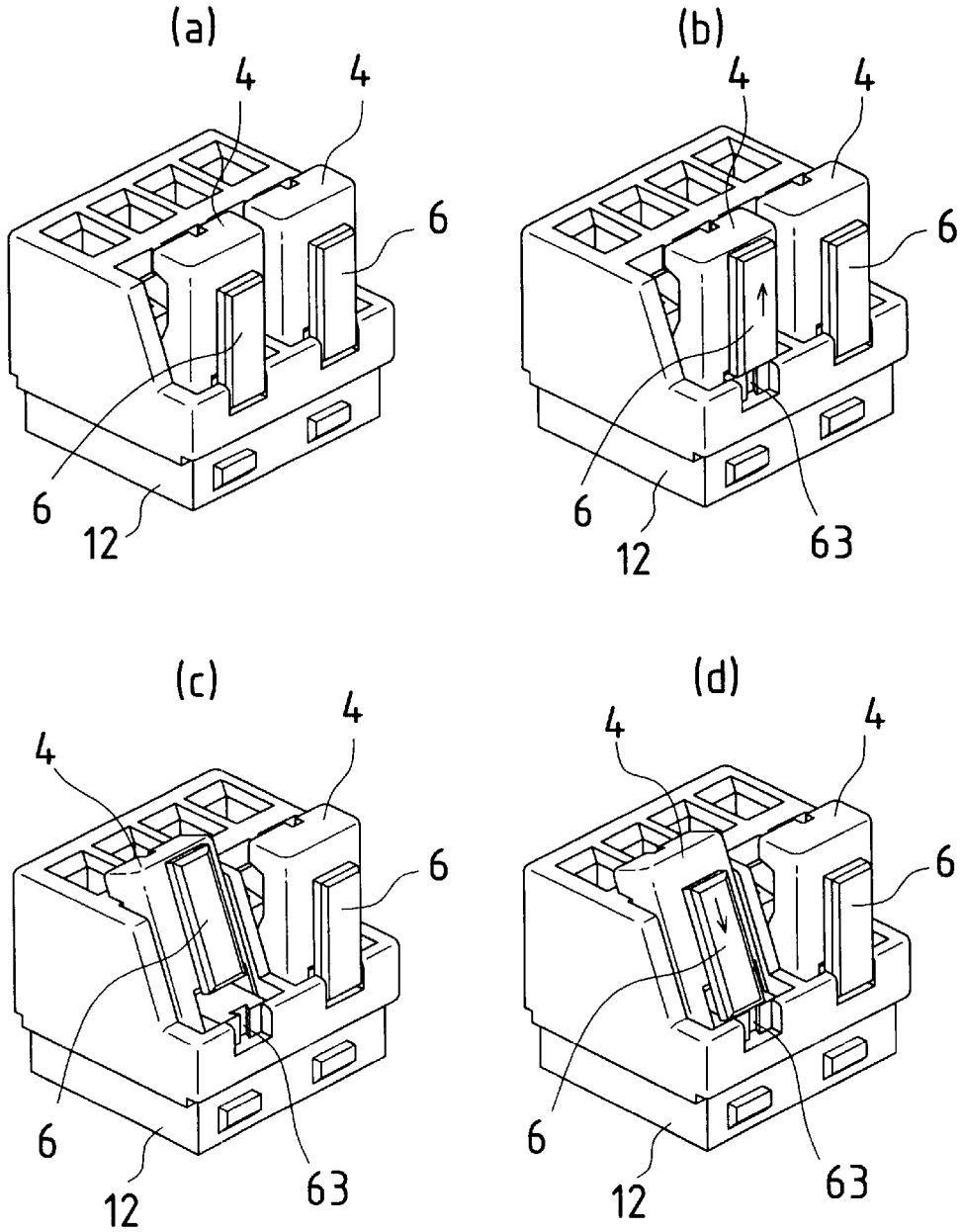
FIG. 18 shows perspective views of another embodiment of the present invention.
Figure 19:
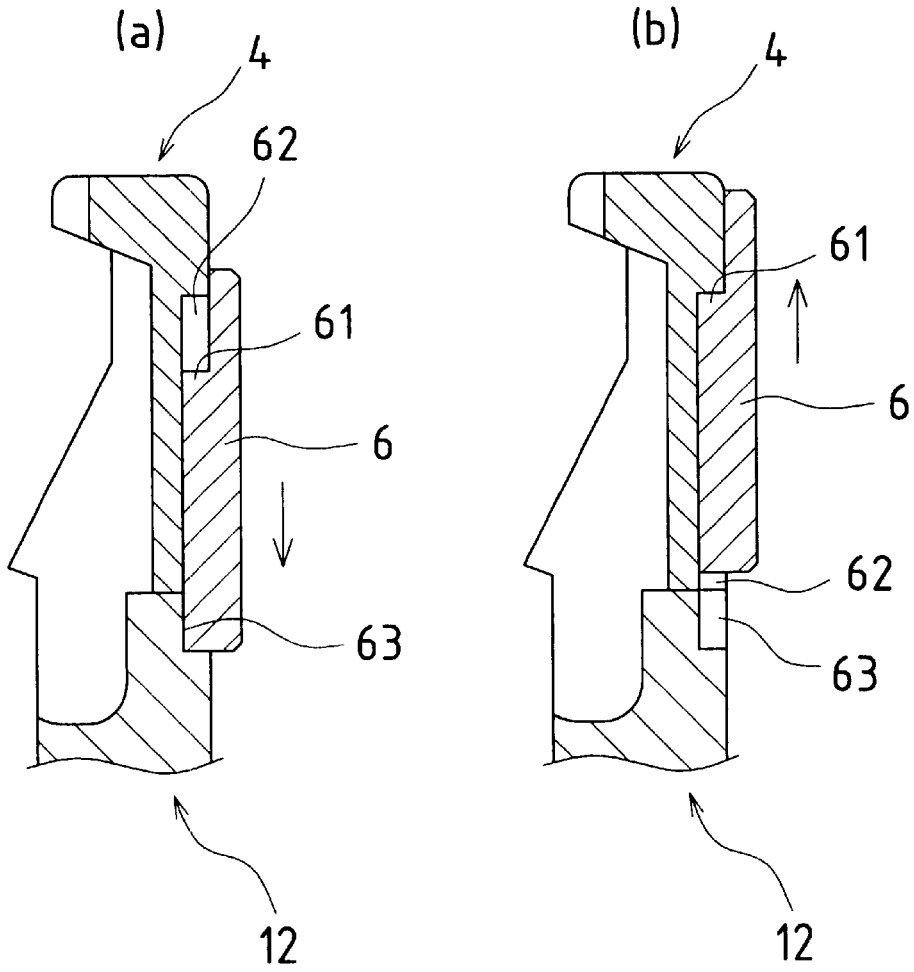
FIG. 19 provides sectional views showing the essential structure of this embodiment.

Referring to FIG. 18 and FIG. 19, the next description relates to another embodiment which is equipped with a locking mechanism for preventing accidental operations.

In a connector of this embodiment, each lever 4 is formed with a dovetail groove 62 which runs in the middle of its front surface. A dovetail groove 63 provided in the bottom case 12 can align with the dovetail groove 62 in the lever 4, when the lever 4 is in the vertical posture. The lever 4 is also equipped with a stopper 6. The stopper 6 has a dovetail tenon 61 which is fittable in the dovetail grooves 62, 63, whereby the stopper 6 can slide along the dovetail grooves 62, 63.

According to this embodiment, if the lever 4 is in the vertical posture and the stopper 6 is moved downwards in the drawing (FIG. 18(*a*) and FIG. 19(*a*)), the dovetail tenon 61 of the stopper 6 fits into the dovetail groove 63 in the bottom case 12. In this state, rotation of the lever 4 is prohibited (the locked state for preventing accidental operations).

Under the locked state for preventing accidental operations, if the stopper is made to slide upwards (FIG. 18(*b*) and FIG. 19(*b*)), the dovetail tenon 61 of the stopper 6 comes out of the dovetail groove 63 in the bottom case 12. Then, the lever 4 is ready to rotate (lock release).

While the lock is released, the lever 4 is depressed and tilted at an angle (FIG. 18(*c*)). In order to keep the lever 4 locked in the operable open state, the stopper 6 is made to slide downwards, such that the dovetail tenon 61 of the stopper 6 is latched at the upper end of the dovetail groove 63 in the bottom case 12 (FIG. 18(*d*)).

In this operably locked state, the conductors 201 of the electric wires 200 are inserted through the connection holes 32*a* in the locking springs 3 in the above-mentioned manner (see FIG. 6). After insertion, the lock on the lever 4 is released by sliding the stopper 6 upwards. As a result, the resilience of the locking springs 3 serves to connect the conductors 201 to the terminal fitting 2, while returning the lever 4 to the vertical posture. Later, the stopper 6 is made to slide downwards, thereby limiting the rotation of the lever 4 and preventing accidental operations.

With the provision of the above-mentioned locking mechanism, it is no longer necessary to keep the lever 4 depressed until the conductors 201 of the electric wires 200 enter the connection holes 32*a* in the locking springs 3. This structure further facilitates wire connecting operations.

With respect to the embodiment shown in FIG. 18 and FIG. 19, the locking mechanism relies on the vertically slidable stopper 6. However, the locking mechanism should not be limited to such mode. As another adoptable locking mechanism, a stopper may be slidable in the horizontal directions. In this case, a dovetail groove in the bottom case 12 is designed in the sliding directions of the stopper. When the lever 4 is in the vertical posture, this dovetail groove is arranged to align with a dovetail groove in the lever 4. Such a locking mechanism can lock/unlock the lever 4 in the same manner as above.

Figure 20:
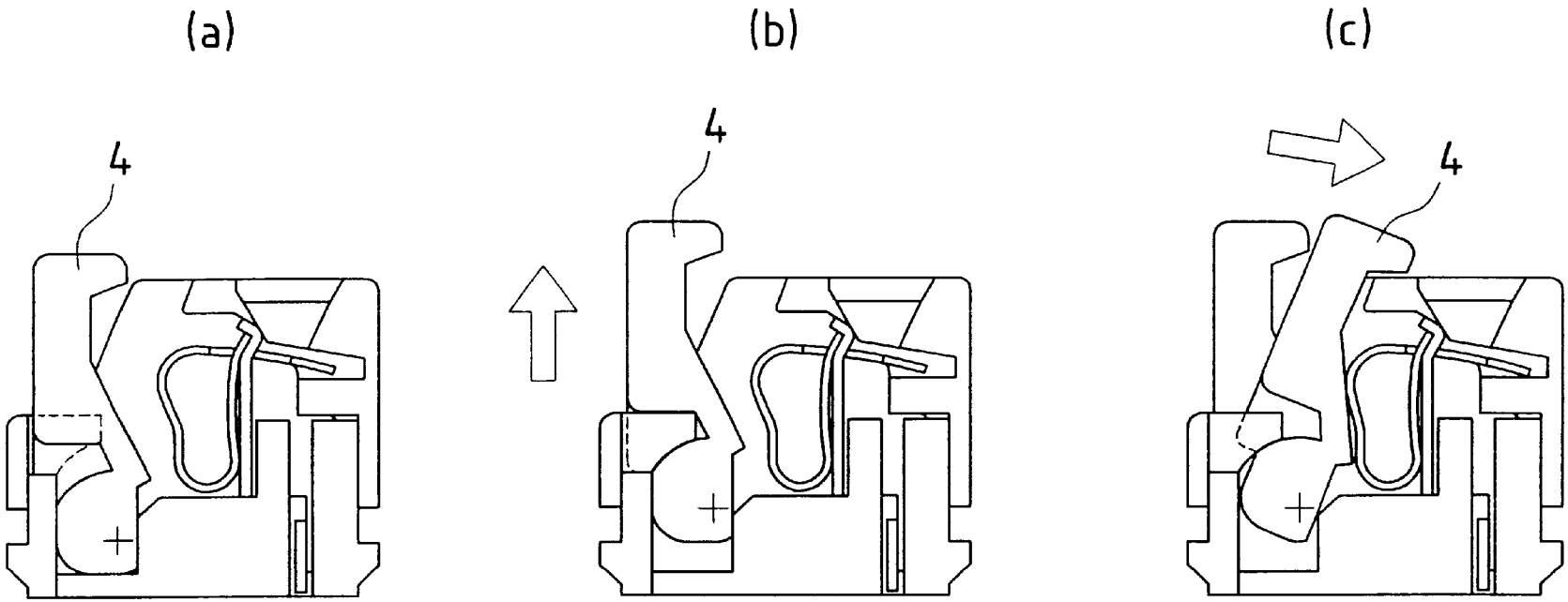
FIGS. 20(*a*)-(*c*) are sectional views illustrating an embodiment having a two-step operation structure.

In addition, as shown in FIG. 20, accidental operations of the lever 4 can be prevented by other structures such as a two-step operation structure (slide and rotate). According to this structure, when the lever 4 in the non-operative position is made to slide upwards to a predetermined position, the locked state is released to make the lever 4 rotatable.

Figure 21:
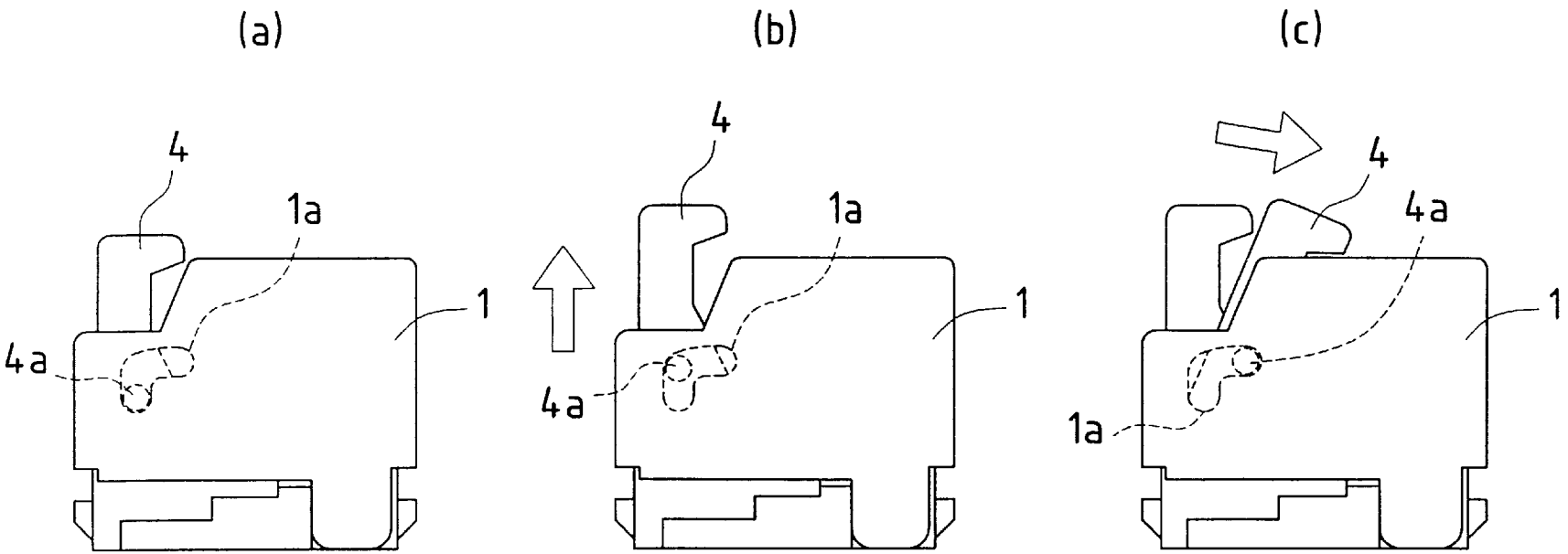
FIGS. 21(*a*)-(*c*) are sectional views illustrating an embodiment having another locking mechanism.
Figure 22:
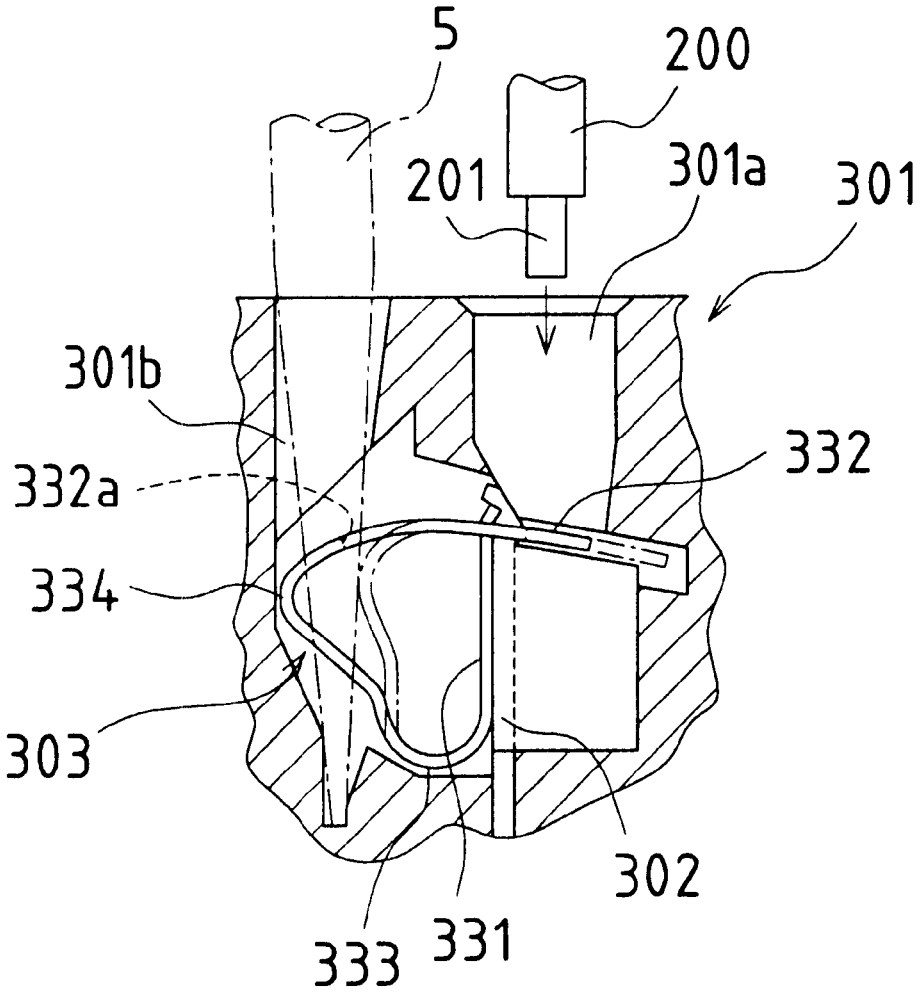
Fig.22 PRIOR ART
FIG. 22 illustrates an example of a conventional connector.

As still another locking mechanism, as shown in FIG. 21, the lever 4 is provided with a projection 4*a* on its lateral side facing the case 1, whereas the case 1 is formed with a groove 1*a* which can fit with the projection 4*a* in order to make the lever 4 slidable. The lever 4 in the non-operative position becomes swingable, when the lever 4 is made to slide upwards to a predetermined position. In turn, the swinging movement displaces the projection to a predetermined position. As a result, the locked state is released to make the lever 4 rotatable.

Incidentally, although each connector mentioned in the above embodiments is equipped with two terminal fittings, the number of the terminal fittings may be one or more than two. Likewise, while each terminal fitting is equipped with two locking springs, the number of the locking springs may be one or more than two.

Further, each of the above embodiments is concerned with an independent connector. Nevertheless, the connector of the present invention may be incorporated within a control unit, a switch, etc.

INDUSTRIAL APPLICABILITY

As has been described, the connector of the present invention is applicable to an electric wire connection for electric equipment (e.g. a control unit, a switch), a terminal block, etc. According to this connector, wire connecting operations can be carried out in a simple manner, without using a screwdriver or other tool. Additionally, a screwdriver may be used to connect an electric wire in a narrow space where the lever cannot be operated by a finger, etc. Thus, this connector is useful for its flexible applicability, being applicable to electric wire connecting operations in various places including a place with a limited space.

What is claimed is:

1. A connector characterized in comprising:

a locking spring which is a lock-like component made of a strip of plate spring, in which a fixed piece is combined with a movable piece via a resilient transformed part and a pushing part, and in which a tip of the fixed piece is inserted into a connection hole formed in the movable piece;

a case for accommodating the locking spring;

a terminal fitting which locates on an outer surface of the fixed piece of the locking spring;

a wire slot formed in a predetermined area on the case, opposite to the movable piece of the locking spring; and a lever which locates in an opening of the case and which serves to press the pushing part of the locking spring;

also characterized in:

that the connection hole faces the wire slot, when the pushing part of the locking spring is pressed by operating the lever, that, when the lever is in a non-operative position, a tool entrance is provided at the opening in such a manner that the tool entrance leads to a contact area where the lever meets the pushing part of the locking spring, and that the lever is provided with a locking mechanism for preventing rotation of the lever.

2. A connector according to claim 1, characterized in that the locking mechanism comprises a slidable stopper provided on the lever and a latch part provided on the case for latching the stopper, so that the lever can be fixed at a predetermined position by latching the stopper on the latch part.

3. A connector according to claim 1, characterized in that the lever is arranged to be slidable from the non-operative position to a predetermined position in order to switch from the locked state to the unlocked state, and that, when the lever is made to slide to a predetermined position, the locking mechanism releases the locked state and makes the lever rotatable.

4. A connector according to claim 1, characterized in that the lever is arranged to be slidable from the non-operative position to a predetermined position in order to switch from the locked state to the unlocked state, and that, when the lever is made to slide to a predetermined position, the locking mechanism makes the lever swingable and the resulting swinging movement causes release of the locked state and makes the lever rotatable.

* * * * *